US007064673B1

(12) United States Patent
Bonham

(10) Patent No.: US 7,064,673 B1
(45) Date of Patent: Jun. 20, 2006

(54) RECONFIGURABLE ILLUMINATED SIGN SYSTEM WITH INDEPENDENT SIGN MODULES

(76) Inventor: Douglas M. Bonham, 3101-168th St. SE., Bothell, WA (US) 98012

( * ) Notice: Subject to any disclaimer, the term of this patent is extended or adjusted under 35 U.S.C. 154(b) by 217 days.

(21) Appl. No.: 10/800,532

(22) Filed: Mar. 15, 2004

(51) Int. Cl.
*G08B 5/00* (2006.01)

(52) U.S. Cl. ..... 340/815.4; 340/691.1; 340/691.6; 340/321; 340/332; 345/1.1

(58) Field of Classification Search ..... 340/815.4, 340/907, 908, 691.1, 691.6, 693.5, 321, 332; 345/1.1
See application file for complete search history.

(56) References Cited

U.S. PATENT DOCUMENTS

| | | | | |
|---|---|---|---|---|
| 4,197,527 | A | 4/1980 | Romney | |
| 4,286,263 | A * | 8/1981 | Lindberg | 345/2.2 |
| 5,230,175 | A | 7/1993 | Follis | |
| 5,321,505 | A | 6/1994 | Leddy | |
| 5,497,888 | A * | 3/1996 | Michaels et al. | 211/10 |
| 5,500,638 | A | 3/1996 | George | |
| 5,523,769 | A | 6/1996 | Lauer et al. | |
| 5,796,376 | A | 8/1998 | Banks | |
| 5,914,698 | A | 6/1999 | Nicholson et al. | |
| 5,990,802 | A | 11/1999 | Maskeny | |
| 6,150,996 | A | 11/2000 | Nicholson et al. | |
| 6,154,994 | A | 12/2000 | O'Brien et al. | |
| 6,167,648 | B1 | 1/2001 | Dimmick | |
| 6,174,065 | B1 | 1/2001 | Schurch | |
| 6,175,342 | B1 | 1/2001 | Nicholson et al. | |
| 6,338,214 | B1 | 1/2002 | Held | |
| 6,347,468 | B1 | 2/2002 | Mohamed | |
| 6,414,650 | B1 | 7/2002 | Nicholson et al. | |
| 6,545,862 | B1 * | 4/2003 | Gettemy et al. | 361/683 |
| 6,917,835 | B1 * | 7/2005 | Oyama et al. | 700/17 |

* cited by examiner

*Primary Examiner*—Daryl C. Pope
(74) *Attorney, Agent, or Firm*—Christensen O'Connor Johnson Kindness PLLC

(57) ABSTRACT

An illuminated sign system is comprised of independent sign modules that may be used individually or associated with additional sign modules to form a sign matrix of variable size and shape. Individual sign modules are independently capable of displaying text or graphics stored in the sign module's memory or as entered by a user. Larger signs can be easily created in the field by connecting multiple sign modules together into a matrix. Control circuitry in the modules detects the presence of adjacent modules and shifts control of the matrix display to the module in a master position. The text or graphics on the module in the master position is preferably resized to fit the size of the matrix. A user can control the entire matrix by controlling the module in the master position.

23 Claims, 7 Drawing Sheets

RECONFIGURABLE ILLUMINATED SIGN SYSTEM WITH INDEPENDENT SIGN MODULES

FIELD OF THE INVENTION

The present invention relates to apparatus and methods providing signs suitable for indoor and outdoor use for the purpose of communicating messages from individuals or groups of individuals to an audience.

BACKGROUND OF THE INVENTION

Illuminated sign systems are desirable for communicating a message to an audience. Sign systems comprised of interconnected modules provide flexibility when assembling signs of various size. Prior art modular signs, however, require cumbersome assembly onto a support structure. Moreover, to configure and control such modular signs, trained personnel are required to use specialized software operating on a separate message control computer. The message control computer addresses specific modules in the sign and determines the portions of the image bitmap that should be displayed on each of the addressable modules. These prior art signs are too large, too heavy, and too complex for untrained consumers to resize or reconfigure in the field. Typically, signs of this type are intended for semi-permanent roadside installations for providing messages related to highway safety or commercial advertising. See, e.g., U.S. Pat. No. 6,414,650, to Nicholson et al. which discloses a modular sign system having a control computer and an extensive support structure with electrical connections between the modules. The size, bulk, cost and skill required to use traditional outdoor signs of this type effectively restrict their use to commercial and government applications.

The prior art further includes portable signs that are not modular and not changeable in size. See, e.g., U.S. Pat. No. 6,347,468, to Mohamed, which discloses a portable illuminated chalkboard for greeting customers at airports.

Additionally, prior art visual displays that distribute a portion of the processing power among modules require a separate controlling central processing unit (CPU) to distribute portions of the bitmap among the modules. The use of a pre-programmed, separate CPU precludes spontaneous and instant connectivity for users of sign modules in the field. See, e.g., U.S. Pat. No. 5,321,505, to Leddy, which discloses a distributed processing system for visual displays.

As can be observed from the foregoing, the prior art fails to provide a reconfigurable modular illuminated sign system that can be easily used by unskilled or minimally trained individual consumers, nor does the prior art provide a reconfigurable modular illuminated sign system comprised of modules that are light and portable for handheld operation. The prior art further fails to provide a reconfigurable illuminated sign system comprising modules that can be used individually or collectively without a controlling computer separate from the modules. The present invention addresses the foregoing needs and other shortcomings in the prior art.

SUMMARY OF THE INVENTION

The present invention is directed to a reconfigurable illuminated sign system comprised of independently-operable sign modules. Preferred embodiments of the present invention provide a small, lightweight, illuminated sign module that can operate as a single stand-alone unit or be connected to other similar sign modules to provide an overall display of increased size. Each sign module may detect the presence of other sign modules connected thereto and thereby cause the system to automatically resize the message display to fit the connected modules, making the overall display instantly changeable from the size of one module to the size of many modules. This feature, combined with the ability of a user to instantly change the message using familiar input devices, such as buttons, computer keyboards, or remote controls, makes embodiments of the invention far more flexible for consumer and advertising applications than otherwise available in the prior art.

In a currently preferred embodiment, a handheld sign module is comprised of an illuminated display that displays a message, a processor that controls the display, and at least one communication port connected to the processor for communicating with another sign module. A message may be any text or graphic that can be shown by the sign module. When the sign module is used in association with another sign module (e.g., connected to another sign module), the sign module determines whether to operate as a master sign module or a slave sign module relative to the other sign module. If the sign module determines it should operate as a master sign module, the sign module controls the message that is shown on both its display and the display of the other sign module. If the sign module determines it should operate as a slave sign module, the sign module displays a message that it receives from the other sign module. When the sign module is not used in association with another sign module, the sign module controls only the message on its display.

A sign module may include multiple communication ports that communicate with other sign modules. For example, communication ports may be disposed on each of the top and bottom side of the sign module, thereby allowing any number of sign modules to be associated with each other in a vertical direction. Similarly, communication ports may be disposed on each of the left and right side of the sign module, thereby allowing any number of sign modules to be associated with each other in a horizontal direction.

A sign module may be configured to scroll the message on its display. When a sign matrix is formed by associating sign modules in a horizontal direction, the sign modules may scroll the message across the combined displays of the sign modules.

When a sign module is associated with other sign modules in a vertical direction, data may be communicated between the sign modules to determine the number of sign modules in the vertical direction. A sign matrix formed by sign modules associated in a vertical direction may display a message that is adjusted in size to fill the vertical height of the combined displays of the sign modules. The size of the message may be adjusted based on the number of sign modules in the vertical direction.

A sign module may receive and respond to user input that changes the content of the message on the display. For example, the user input may be a message select button that causes the sign module to display stored messages and receive further input from the user indicating a desired message. The sign module may replace the message on its display with the desired message indicated by the user. Another example of a user input is a one-shot message button that causes a temporary display of a message for a predetermined period of time. The user input may also enable a user to modify one or more of the messages for display by the sign module. In that regard, the user may advantageously use a keyboard or computing device to provide the user input.

In one embodiment, the user input may be received from a control located on the sign module. In another embodiment, the user input may be received from a control located remotely from the sign module. A remote user control may communicate with the sign module via wireless or wired communication.

A sign module may further be configured to communicate software instructions to and/or from another sign module. For example, a sign module may receive updated software from another sign module and replace software operating in the sign module with the updated software. Alternatively, the sign module may transmit updated software to another sign module.

In one embodiment, sign modules are associated with each other by being physically connected to each other. One or more mechanical fasteners may be used to physically support the connection of one sign module to another sign module. Where the sign modules are constructed with a rectangular shape, the connection of sign modules to each other may result in an overall rectangular sign matrix.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF PREFERRED EMBODIMENTS

A reconfigurable illuminated sign system according to one embodiment is comprised of independently-operable sign modules. The sign modules may be small and lightweight, and may operate as a single stand-alone unit or be connected to other sign modules to provide a sign matrix with an overall display of increased size.

The sign modules are each powered by a voltage supply. In one embodiment, a 12-volt supply voltage may be used to power a sign module from a vehicle. However, embodiments of the invention are unlike prior illuminated signs designed for use from a vehicle in that the present invention provides a versatile handheld design which allows the user to take the sign module from the vehicle and use it for a wide range of other applications, including advertising from a street corner, in store fronts or home businesses, and/or making statements at political rallies and conventions, spectator sporting events, rock concerts, etc. Social events such as political rallies, spectator sports, and concerts may encourage individuals who each own a sign module of the invention to connect the sign modules together to create a larger display. Accordingly, embodiments of the invention enable a group of individuals in a spontaneous social setting to make collective statements to a larger audience in a way that is very different from the prior art.

Figure 1:
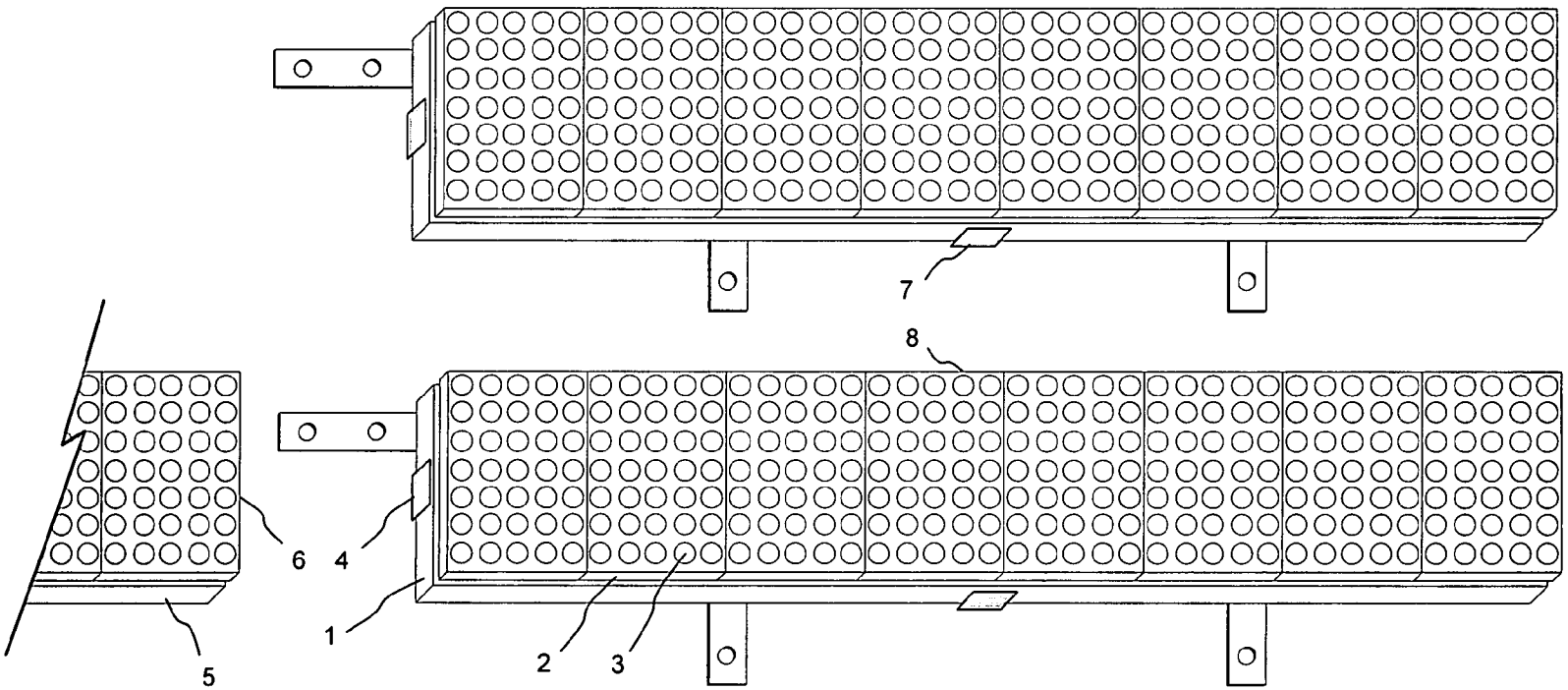
FIG. 1 is a pictorial front view of one exemplary embodiment of the invention showing sign modules constructed in accordance with the invention with connections that may be used to connect the sign modules.

In one preferred embodiment, a sign module is comprised of an electronic circuit board on which an array of light-emitting diodes (LEDs) are mounted. FIG. 1 depicts a front view of a sign module 1 that includes a plurality of LED array modules 2 mounted on an electronic circuit board. Each LED array module 2 is comprised of a rectangular array of individual LED elements 3. Persons having ordinary skill in the art of electronics will recognize that LEDs are available in a variety of colors and intensities, and can be readily purchased already packaged in modules. One such module includes 35 LEDs arranged in a rectangular pattern of 5 columns and 7 rows. Other LED arrays may be used. A set of eight such LED array modules 2 can be used to build the display of a sign module 1, as shown in FIG. 1, which typically is used to display about eight characters. Although sign modules constructed according to the invention are not limited to displaying eight characters, and may in fact accommodate a greater or fewer number of characters, eight characters is believed to be a reasonable size for scrolling text messages. Sign modules are also capable of displaying graphics, as will be described herein.

The circuit board on which the LED array modules 2 are mounted is preferably designed in rectangular form and is preferably sized no larger than the LED array modules 2 in order to allow multiple sign modules to be connected to each other to form a matrix. The electronic circuit board includes a processor (see, e.g., FIG. 3B), an example of which may be a Motorola HCS12 16-bit microcontroller. A microcontroller of this type has sufficient internal RAM, EEPROM, and flash memory, plus serial ports for communicating with adjacent signs, and enough input/output (I/O) lines to control the LEDs in the sign module and further operate to detect adjacent sign modules. Suitable interfaces between a microcontroller and LED arrays are well documented in the literature and can be accessed, for example, in application notes available from manufacturers of LED array modules. Likewise, interfaces between a microcontroller and other optical display components, such as liquid crystal displays, cathode ray tubes, and incandescent lamps, are also readily known and available.

Figure 2:
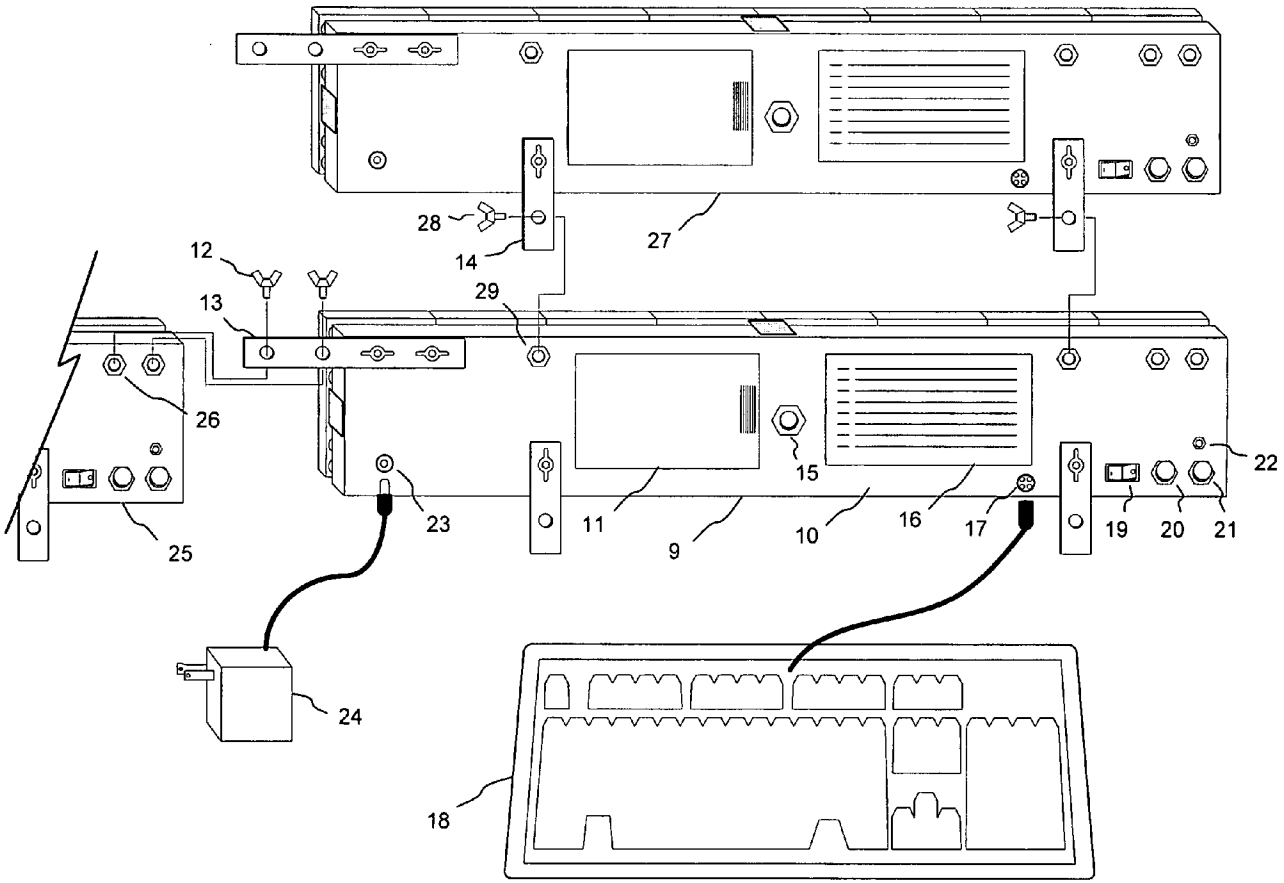
FIG. 2 is a pictorial rear view of the sign modules shown in FIG. 1 with optional power and keyboard devices that may connect to sign modules of the invention.

A preferred embodiment of the sign module further contains components for converting a power input, such as a 12-volt DC power input, to the voltage necessary to power the processor and the LEDs in the module. Due to the amount of current drawn by multiple LEDs, a switching-type power converter is preferred over linear components. Sufficient filtering of the power components is typically required to prevent voltage spikes from switching of the LEDs to affect the digital logic of the microcontroller. A 12-volt DC power input can be supplied to the electronic circuit board through a standard circular power jack 23, as illustrated in FIG. 2.

When a sign module is used near a 110 or 220 AC power socket, power may be supplied to the sign module using a readily available AC-DC power converter 24. Alternatively, when AC wall power is not available, a vehicle cigarette lighter or battery power can be used to supply the input power for the module. If desired, batteries may be attached to the back of the sign module 1 or carried separately by the user with a cable that reaches from the battery pack to the power input 23 of the module, depending on the size of the batteries needed to power the module.

The sign modules depicted in FIG. 1 each have communication ports on the left and right sides and the top and bottom sides of the sign modules. In this particular embodiment, the communication ports are implemented as infrared transceivers, though any suitable communication technologies may be used. The infrared port 4 on the left side of the sign module 1 is configured to communicate with an infrared port 6 respectively positioned on an adjacent sign module 5. In a preferred embodiment, sign modules to the right, as seen by the viewer of the sign, act as a "master" that controls "slave" sign modules connected to the left. This preferred orientation is driven by the fact that a scrolling text message typically moves from right to left across a display. Accordingly, in the context of FIG. 1, the sign module 1 is in a master position relative to the sign module 5 which, when connected to the sign module 1, is in a slave position. If the master sign module 1 is scrolling the letter A, for example, and the letter A reaches the left edge of the module display, the master sign module 1 communicates to the adjacent left slave module 5 to begin displaying a letter A at the right edge of its display. In this fashion, a scrolling message is gradually transferred, column-by-column, from the left edge of the master module's display to the right edge of the slave module's display.

A master sign module, e.g., sign module 1, does not necessarily need to know that a slave sign module is connected to its left. The master sign module 1 may simply broadcast the bit-mapped columns leaving the left edge of the display through its left communication port 4. If there is no slave sign module connected to the left of the master sign module 1, the scrolling message ends at the left side of the master module's display. If a slave sign module, e.g., sign module 5, is present, the slave module 5 receives the bit-mapped columns from the master sign module 1 via the right-side communication port 6, effectively extending the horizontal distance that a scrolling text message can be displayed and viewed.

In this embodiment, sign modules may monitor the communication port on their right, e.g., communication port 6 for sign module 5, to determine whether they are receiving valid data and should be operating as a slave module. If communication signals are not received by the right side communication port 6, the sign module 5 determines there is no sign module to the right and thus considers itself to be a master module. As such, the sign module 5 will display its own message. If the sign module 5 considers itself to be a slave module, it displays the bit-mapped columns that it receives from the master module 1 located to the right.

One or more of the communication ports located on the side of a sign module may also be used for connecting to a computing device for uploading messages, graphics, or updating the software operating in the sign module. For example, the infrared port 6 on the right side of a sign module may be configured to communicate with an infrared port of a personal computer or other data communication device, or alternatively communicate with an adapter, such as a USB-to-infrared adapter connected to a computer. Communication with a computer is optional and is not required to operate the sign module or reconfigure a matrix of sign modules. Communication with a computer may advantageously allow for upgrading features of the software operating on the module, or as an alternative to a direct keyboard connection for adding and modifying messages and graphics, as will be discussed below. Computer communication through the right-side communication port of a sign module may allow the computer to act as a surrogate master module for controlling a matrix of sign modules, if desired.

As noted earlier, sign modules constructed according to a preferred embodiment of the invention further include communication ports located on the top and bottom sides of the sign modules. For example, the sign module 1 in FIG. 1 includes a communication port 8 on the top side of the module, while the sign module above it includes a communication port 7 on the bottom side of the module. When two sign modules are connected vertically, the top communication port, e.g., infrared port 8, is positioned to communicate with a respective communication port 7 located on the bottom of the vertically-adjacent sign module.

As with left-to-right connected sign modules, sign modules connected in a vertical direction also assume a master or slave mode of operation, depending on their position in the sign matrix. In one embodiment, a sign module may communicate data via its bottom communication port 7 reporting the number of signs connected vertically above the sign module. If the sign module is at the top of the overall sign matrix, the module transmits a signal reporting "one" module via its bottom side communication port 7. Assuming this module is connected to the sign module 1 in FIG. 1, the module 1 receives the signal transmitted from the upper module via its top side communication port 8. If another sign module (not shown) were connected vertically below the module 1, the module 1 would in turn transmit a signal via its bottom side communication port reporting "two" modules (an increment of one from the report of modules received from the module immediately above the module 1). Accordingly, each sign module that receives a valid signal transmission at its top-side communication port reporting a number of modules increments that number by one and, in turn, transmits a signal with the incremented number via its bottom-side communication port. In this fashion, data is communicated from top to bottom in a sign matrix of sign modules that, when received by the sign module at the bottom of the matrix, identifies the total number of vertically disposed modules in that column of sign modules. A sign module that does not receive any valid signals at its top-side communication port may assume it is at the top of the sign matrix.

A sign module may also monitor its bottom-side communication port for valid communication signals from a module connected below it. If a sign module receives no valid communication signal at its bottom-side communication port, the sign module may assume it is at the bottom of a sign matrix. Sign modules at the bottom of a sign matrix act as a master sign module to the slave sign modules that are connected above it. Since the master sign module at the bottom of a column of modules knows how many sign modules are connected above it, the master sign module can determine a proper size for the characters or graphics being displayed in the column to fill the display in the vertical direction. For example, where characters are being displayed, the master sign module may determine a font size for the characters to fill the display in the vertical direction. Knowing the font size allows the master sign module to determine the bitmap for display by each of the sign modules above it. If, for example, there are four sign modules connected vertically, the master sign module at the bottom divides the character to be displayed into four pieces. The bottom sign module displays the bitmap of the lowest of the four pieces on its own LEDs and communicates the bitmaps of the remaining three pieces to the sign module connected vertically above it. Communication of data in this embodiment is accomplished by the communication ports 8 and 7, for example, as shown in FIG. 1. The sign module connected above the bottom (master) module receives the data communication, displays the bitmap of the second-to-bottom piece, and communicates the remaining two pieces of the bitmap to the signs above it. This process repeats itself for the next vertically-adjacent sign module that displays the second-to-top bitmap on its display and communicates the remaining top piece to the top sign module for display.

As can be understood in this embodiment, the display in each column of sign modules in a matrix is controlled by the master sign module at the bottom of the column. As to the bottom row of the sign matrix, the rightmost sign module acts as a master module to the sign modules to its left. Accordingly, the display of the entire sign matrix in this example is effectively controlled by the master sign module at the bottom right corner of the matrix. The master sign module at the bottom right corner knows the number of sign modules vertically connected above it, as earlier described and communicates the portion of the bitmap to be displayed on each of the vertically adjacent sign modules in the rightmost column of the sign matrix. The master sign module at the bottom right corner also communicates bitmap data to the slave sign module at its left to direct the display in the next column to the left. While the bottom sign module in the next column to the left is a slave to the bottom right sign module, the bottom sign module to the left acts as a master to those sign modules connected vertically above it. Accordingly, as the next-to-left sign module receives bitmap data from the master sign module to its right, the sign module determines the appropriate display for each of the sign modules in the column of modules above it. This arrangement of master-slave relationships is perpetuated across the bottom row of the sign matrix for each of the columns in the matrix.

As will be described in greater detail in regard to FIG. 5, the master sign module at the bottom right corner of a sign matrix may include a software timer that determines when its time to shift the bitmap of the display by one column to the left in order to create a scrolling message. When the display is shifted to the left, the master sign module retrieves the next column of the bitmap from its memory, resizes and breaks the bitmap into four pieces, displays the bottommost piece on its display, and transmits the three remaining pieces of the bitmap to the three signs above it. Moreover, the master sign module shifts the bitmap at its left edge to the sign module at its left for display at the right edge of the adjacent module. All of the sign modules along the bottom of the display thus shift the bitmapped columns to the left, and each module displays the new piece of the bitmap received at its right edge. The sign module at the bottom left corner position may transmit its left most bitmap as if there was another adjacent module to its left, but if no adjacent module is present to its left, the shifted bitmap is effectively dropped from the overall display.

FIG. 2 depicts a rear view of sign modules as shown in FIG. 1. Each sign module may include a plastic enclosure 10 to protect the electronic components housed within the enclosure. The plastic enclosure 10 may include a user-serviceable door 11 for replacing batteries that power the sign module. Fasteners 12 and 28, and brackets 13 and 14, as depicted, may be used to secure adjacent sign modules to each other. Other embodiments of the invention may use alternative connection mechanisms to secure one module to another. In addition to providing access to replaceable batteries, the user-serviceable door 11 may also provide access to a compartment for storing the fasteners 12 and 28, and brackets 13 and 14, when they are not being used to secure adjacent sign modules. If desired, a ¼ inch threaded mounting hole 15 may be embedded in the plastic enclosure 10 to aid in mounting the sign module to a user-supplied support structure. Furthermore, a paper label 16 may provide users with readily-available instructions for operating the sign module.

Each sign module may include a keyboard connector 17 that enables a standard computer keyboard 18 to be connected to the sign module. Alternatively, infrared communication between a computer keyboard 18 and a sign module may be accomplished using an infrared port on the side of the sign module, as discussed in regard to FIG. 1.

Embodiments of the sign module may further include controls that enable a user to operate various features of the sign module. For example, an on-off switch 19 allows users to activate or deactivate the display. A message select push button 20 allows users to step through a series of previously-stored messages or graphics and choose a particular message or graphic for display. A one-shot push button 21 may allow users to temporarily interrupt the current display with a preprogrammed one-shot message of text or graphics. One-shot messages allow a user of the module to instantly display an alternative message in response to targeted readers or events. A one-shot electrical jack 22 may allow users to trigger a one-shot message using a wired remote control, a motion detector, or other electronic device or sensor. A signal received at the one-shot jack 22 may provide the same functionality as the one-shot push button 21. The power connector 23 provides for connection to a DC power supply, e.g., AC-DC power converter 24.

As depicted in FIG. 2, an additional sign module 25 may be attached horizontally to the sign module 9 using a horizontal bracket 13. The horizontal bracket 13 fastens to the sign module 25 with wing bolts 12 and threaded holes 26. Similarly, a sign module 27 can be attached vertically to the sign module 9 using vertical brackets 14. Vertical brackets 14 fasten to the sign module 9 with wing bolts 28 and threaded holes 29. The means of attaching adjacent sign modules to each other is not limited to the brackets and wing bolts depicted in FIG. 2. A wide variety of readily-available fastening devices, integrated with or separate from the sign modules, can be used.

In a preferred embodiment, the keyboard 18 is not normally required to be attached to a sign module while the module is displaying messages. The keyboard 18 is useful for inputting and editing messages into the memory of the sign module, after which the keyboard may be removed. A user with a standard computer keyboard 18 connected to the master sign module can create a bitmap that is communicated as discussed above to the entire sign matrix. Signs that have assumed a slave mode of operation ignore signals received from keyboards and other input devices, and instead look to receive display information via one or more of the side communication ports from adjacent sign modules. The keyboard connector 17 may be a standard PS2 computer keyboard jack. Details regarding electronic hardware and software interfaces for communicating between keyboards and processors are readily available in the device literature.

As may be appreciated, there are numerous possible variations of keyboard user interfaces. Instructions for the use of keys may be printed on the paper label 16 on the back of the sign module for easy reference. For example, keystrokes may be used to change the sign module from a display mode to an edit mode of operation. In an edit mode, keystrokes received from the keyboard 18 may define the characters to be stored in the memory of the sign module for a new text message. While in edit mode, a keystroke such as a function key may switch from editing text to editing graphics. Editing graphics may be performed column-by-column, beginning at one edge of the display. The number keys, for example, may define which LED elements in the active column are lit. When one column is completed, arrow keys may be used to move the display to the next adjacent column, allowing a new column of the display to be defined. This process repeats for each column of the graphical display until the user has defined the entire display. Another keystroke may be used to return the sign module to a normal display mode of operation.

As should be understood from the foregoing, sign modules may be configured to receive one or more user inputs, e.g., to change the content of the message on the display. For example, in one aspect, a user input may be a message select input that causes the sign module to display stored messages and receive further input from the user indicating a desired message to replace the currently-displayed message. In another aspect, a user input may be a one-shot message input that causes the sign module to temporarily display a one-shot message for a predetermined period of time. A user input, such as a keyboard or computing device, may communicate with a sign module and enable the user to modify a message for display on the sign module. User input devices may be configured for wireless or wired communication, and thus may be located remote from the sign module or on the sign module. Commercially-available voice recognition circuitry, which may be voice recognition software operating in the sign module, may further be used in conjunction with a microphone user input to communicate information and commands to the sign module.

Figure 3A:
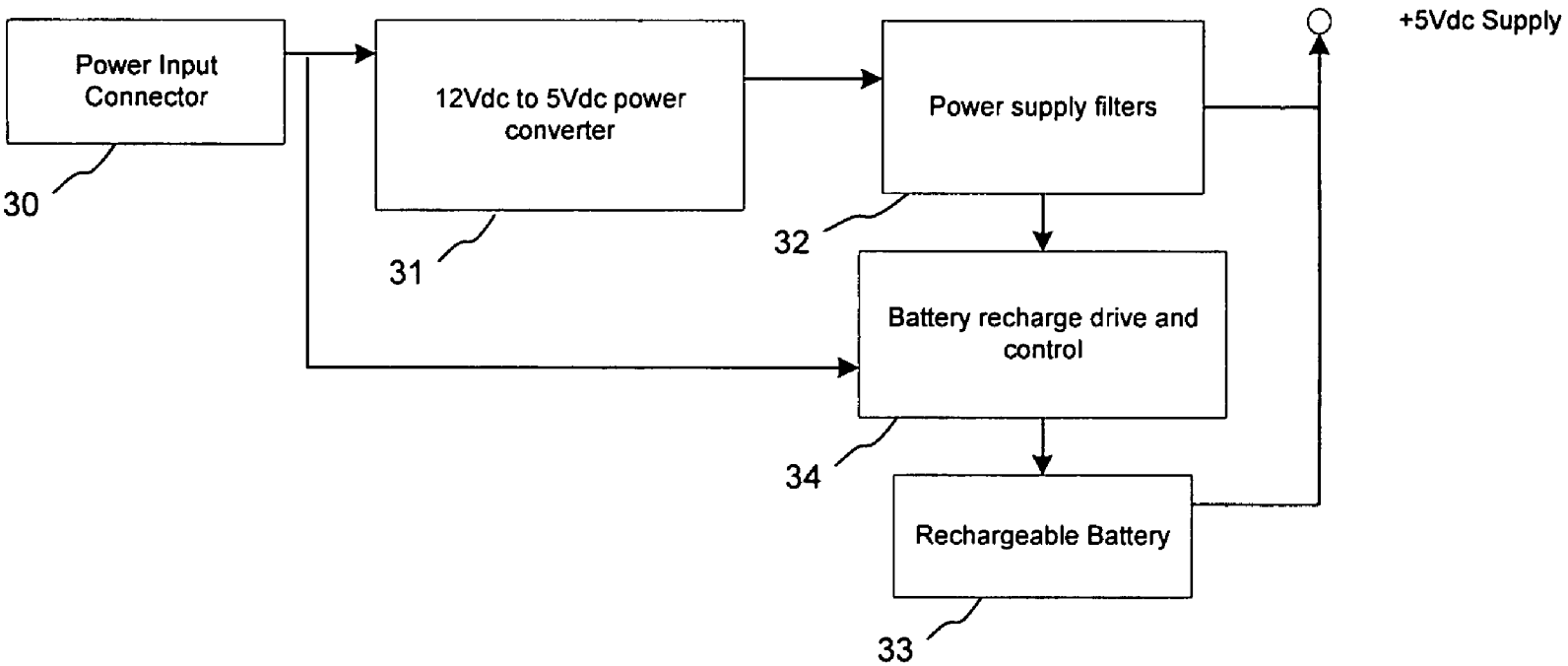
FIGS. 3A and 3B are block diagrams showing components that may be used to construct a sign module in accordance with one embodiment of the invention.
Figure 3B:
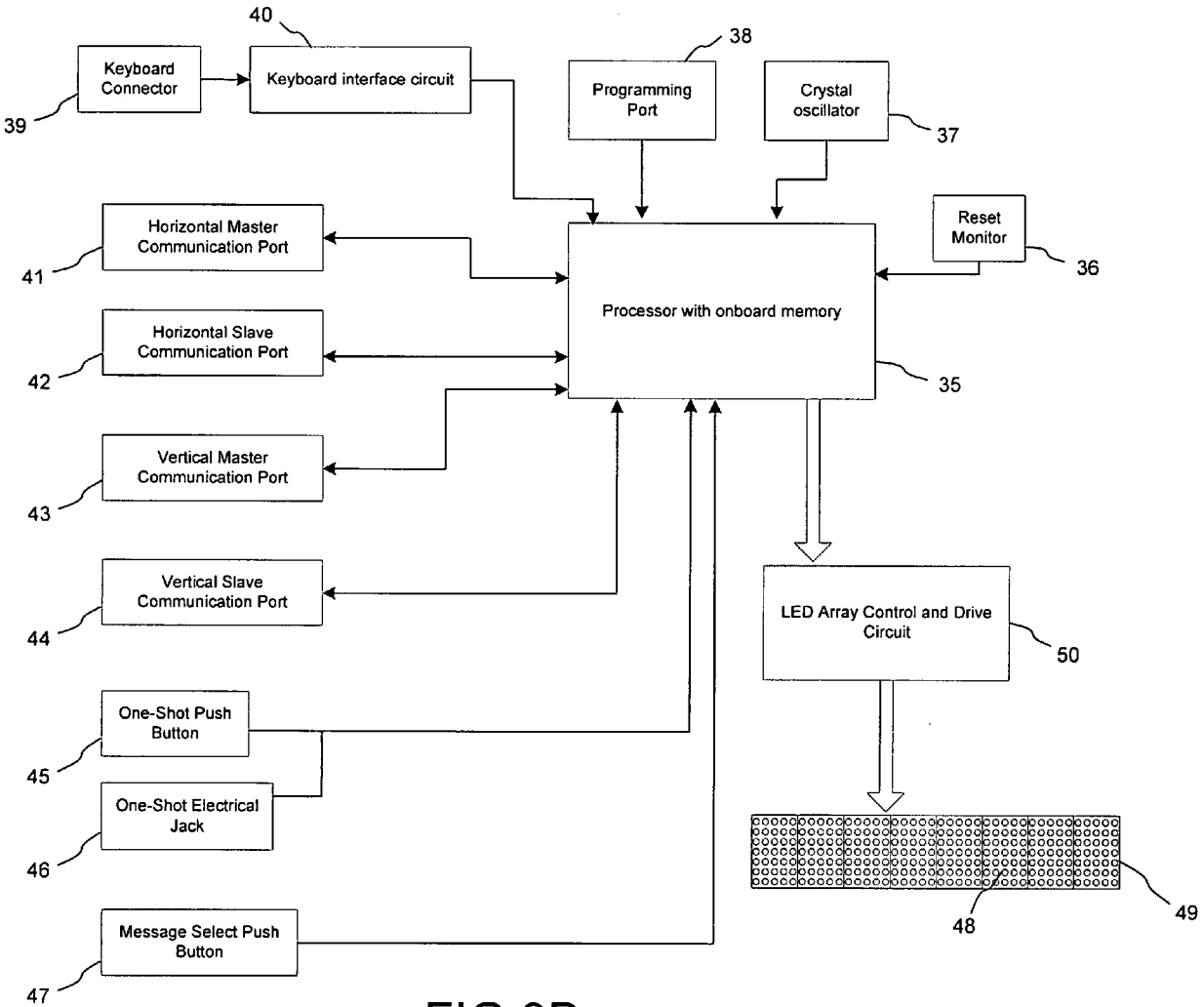

FIGS. 3A and 3B depict an electrical block diagram of components that may be used to construct an embodiment of a sign module of the invention. A power input connector 30, which may be a 2.1 mm power jack, for example, may allow commercially-available external power supplies to provide power to the sign module. One exemplary power input connector is manufactured by Cui Stack under part No. PJ-202A. Assuming the input power is 12 volts DC, 12-volt DC to 5-volt DC power converter 31 may be used to convert the 12-volt DC input power to 5 volts DC. A switching power integrated circuit, such as a power IC manufactured by National Semiconductor under the part No. LM2678, could be used for the power converter 31. Details on components suitable for use in the power converter 31 are available in application notes from National Semiconductor. The output of the power converter 31 may be filtered by one or more power supply filters 32. Application notes from manufacturers, such as National Semiconductor, describe components that may be used for a suitable power supply filter 32. The output of the power supply filter 32, in this example, is a 5-volt DC supply that is used to power the remaining electrical components of the sign module. A rechargeable battery 33 in the sign module provides power for the sign when external power is not supplied to the power input connector 30. A battery recharge drive and control circuit 34 monitors the condition of the rechargeable battery 33 and routes external power to the battery 33 when appropriate. Readily-available application notes from battery manufacturers provide additional details that allow persons of ordinary skill in the art to select a battery 33 and implement the battery recharge drive and control circuit 34.

Figure 4A:
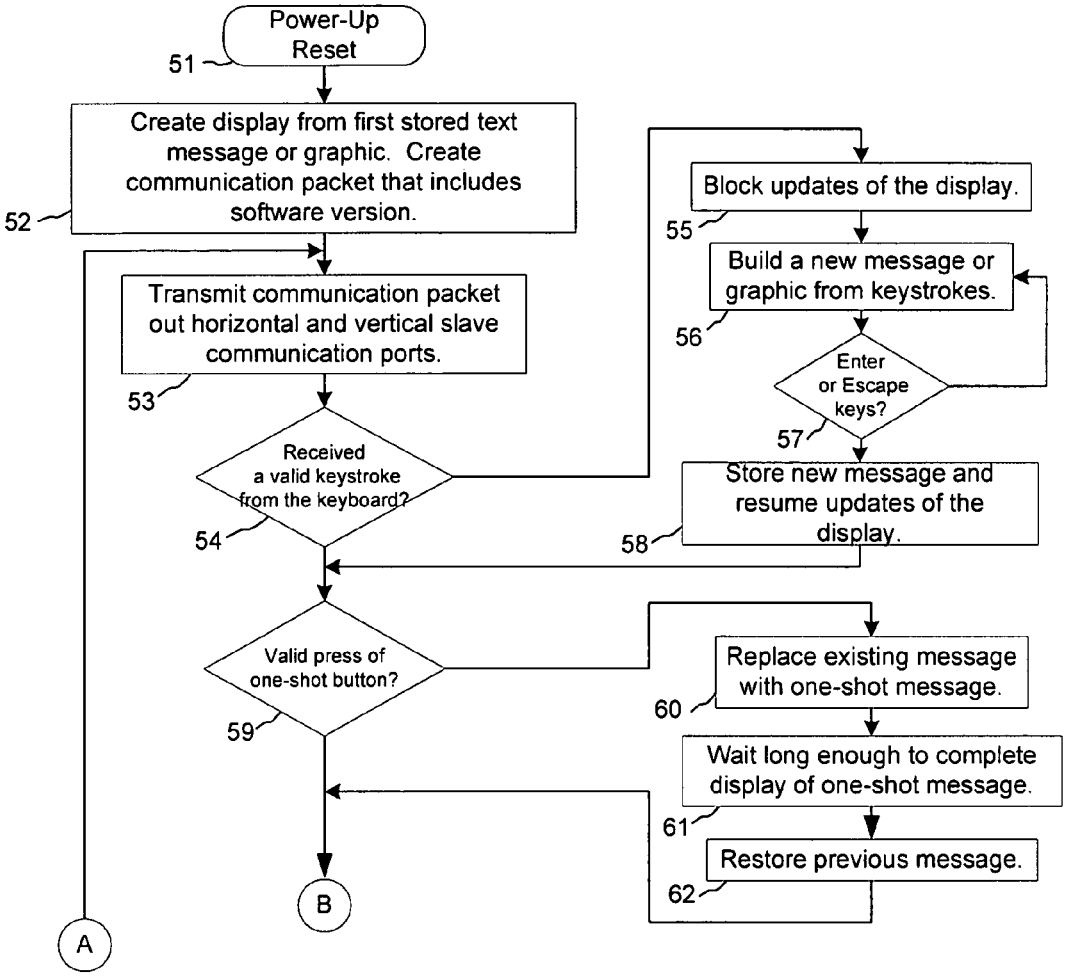
FIGS. 4A and 4B are flow diagrams of actions that may be undertaken by software operating in a sign module constructed according to the invention.
Figure 4B:
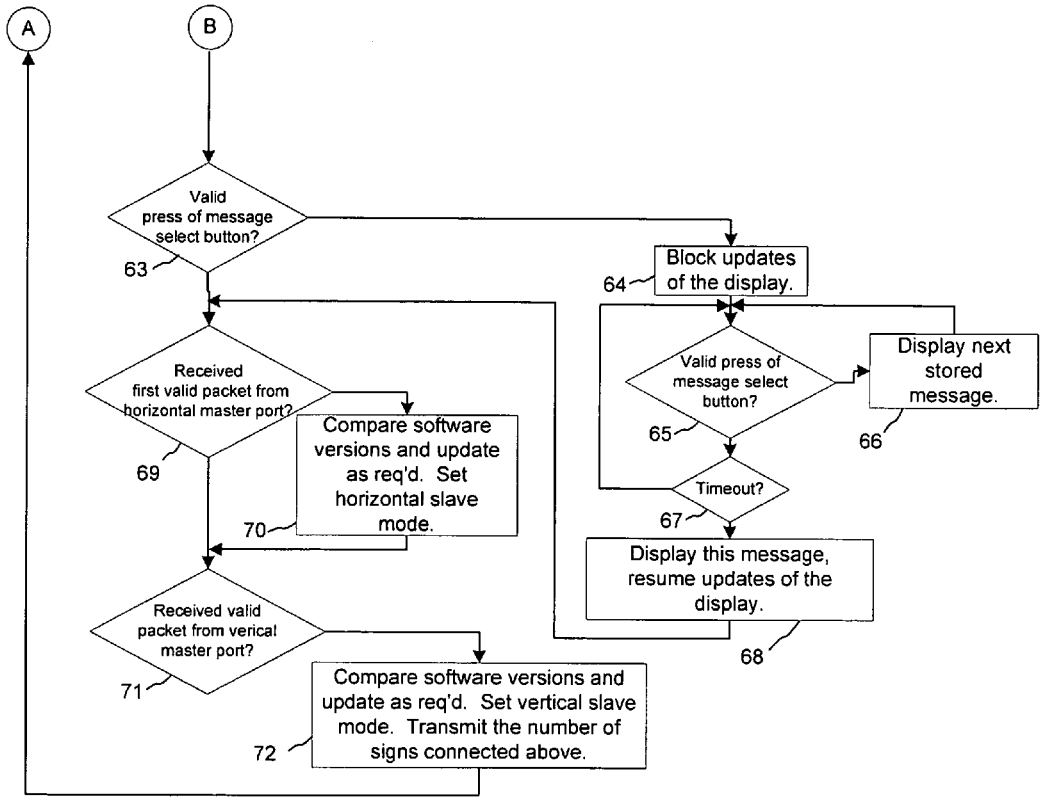

The sign module in this embodiment further includes a processor 35 which controls the display as defined by software instructions stored in memory, preferably non-volatile memory onboard the processor, though other forms of memory are suitable. FIGS. 4A, 4B, and 5 describe some of the actions that may be undertaken by the software operating on the processor 35. As noted earlier, one example of a suitable processor 35 is a microcontroller manufactured by Motorola under part No. HCS12. In this description, the processor 35 is hereinafter referred to as a microcontroller, though embodiments of the invention may use other forms of processors as desired.

A reset monitor 36 connected to the microcontroller 35 provides a controlled start-up and shut-down of the software during power up and power down. A crystal oscillator 37 drives the necessary clock functions on board the microcontroller 35. A programming port 38 may be connected to the microcontroller 35 to allow a user to connect a computer to the sign module for purposes of programming the module. In some embodiments, the programming port 38 may be provided by one or more of the communication ports 41, 42, 43, 44 described below.

A keyboard connector 39 is used for connecting an external computer keyboard (e.g., keyboard 18) to a keyboard interface circuit 40 operating in the sign module. Although a keyboard is not required to display stored messages or graphics, a keyboard may be connected when a user wishes to change the messages or graphics that are stored in the sign module. Further details of an electrical interface between a keyboard and a microcontroller are readily available in application notes from keyboard manufacturers. In a typical embodiment, a keyboard interface circuit 40 comprises a data line, a clock line, ground, 5-volt input supply, and diodes to protect the microcontroller 35 from electrostatic discharge.

The sign module, in this embodiment, utilizes infrared transceivers for four communication ports 41, 42, 43, and 44, respectively, located on the right, left, bottom, and top sides of the sign module. One example of an infrared port that could be used for the communication ports 41, 42, 43, and 44 is manufactured by Sharp under part No. GP2W0004YP. Alternative embodiments of the sign module may utilize other forms of communication in place of infrared transmission. The horizontal master communication port 41, in this example, is an infrared transceiver located on the right side of the sign module, and is designed to receive data communications from a master sign module located to the right. A master sign module located to the right would communicate from its left side horizontal slave communication port 42 to the horizontal master communication port 41 of the sign module to its left. The vertical master communication port 43, in this example, is an infrared transceiver located on the bottom of a sign module and is designed to receive data communication from a master sign module located below it. A master sign module located below would communicate from its top side vertical slave communication port 44 to the vertical master communication port 43 of the module located above.

As noted earlier, embodiments of the invention may include additional controls that allow the user to configure and modify the operation of the sign module. A one-shot push button 45 may be a normally-open momentary switch that is connected to an input pin on the microcontroller 35. When software running on the microcontroller 35 receives an indication from the one-shot push button 45 that the button has been pushed, the software running on the microcontroller 35 may interpret that as indicating the user wants to temporarily halt the current message display in favor of displaying a different message that the user had previously defined as a one-shot message. After the one-shot message has been displayed, the software returns to displaying the message that was being displayed prior to the press of the one-shot push button 45. This feature allows a user to target a message to a particular reader action or event, as desired. An alternate way for a user to take advantage of the one-shot push button 45 is to define the main message as a blank display. Doing so makes the sign module appear to be off. Pressing the one-shot push button 45 from this state makes the one-shot message appear to turn on and display a message briefly before the sign returns to the blank display and appears to turn off.

A one-shot electrical jack 46 may provide the same functionality as the one-shot push button 45. The one-shot electrical jack 46, in this embodiment, comprises electrical contacts that are wired in parallel to the one-shot push button 45. A user may connect a wire pair from the electrical jack 46 to a remotely located push button or any other electrical sensor that provides a current path when activated, such as a phototransistor. This allows the user to remotely trigger the display of a predefined one-shot message stored in the microcontroller memory.

A message select push button 47 may be a normally-open momentary switch that is connected to an input pin on the microcontroller 35. When software running on the microcontroller 35 receives an indication from the message select push button 47 that the button has been pushed, the software may interpret that as indicating the user wants to display a different message or graphic than the one currently being displayed. The microcontroller 35 may store numerous messages and graphics in memory. Each user press of the message select push button 47 may cause the microcontroller 35 to select a different one of the stored messages for display on the sign module. In a preferred embodiment, the microcontroller 35 steps through the stored messages in a serial fashion. After displaying the last stored message, the next press of the push button 47 causes the microcontroller to again display the first message. This allows a user to continually step through all of the stored messages until the desired message is displayed. In other embodiments, an interface may be provided in which the user can directly select the desired message without having to step through the stored messages.

The visual display 49 may be formed of modules of LEDs 48 as shown on FIG. 3B. A message is displayed by the sign module by powering certain ones of the LEDs 48 that form the visual display 49. One example of an LED module having 35 LEDs arranged in a rectangular matrix of five columns and seven rows is manufactured by Lite-On, Inc. under the part number LTP-2057AKA. Alternative embodiments of the sign module may use a visual display 49 comprised of other types of optical display components, including cathode ray tubes, incandescent bulbs, and liquid crystal displays. Application notes from the manufacturers of optical components are available to persons having ordinary skill in electronics and describe the details of the electrical interfaces between the optical components and microcontrollers.

A preferred embodiment of a sign module includes a network of MOSFET drivers and digital latches that provide an LED array drive and control circuit 50. For example, the LED modules in the visual display 49 may be driven by N-channel and P-channel MOSFETs manufactured by Zetec under the part numbers ZXM61N02FTA and ZXM61P02FTA. A suitable digital latch that can be used to control the rows of LEDs in the visual display 49 is manufactured by Texas Instruments under part number SN74HC259D.

FIGS. 4A and 4B are flow diagrams describing a software process that may be performed by executing software instructions stored in the microcontroller memory. The software process begins at block 51 whenever the sign module is initially powered up or reset. At block 52, the display is initialized with the first text message or graphic stored in the microcontroller's memory. In a preferred embodiment, data communication between connected sign modules uses data organized into communication packets. Other embodiments may communicate data in other forms. At block 52, communication packets that may be sent periodically from the sign module are initialized. One or more of the communication packets may include the version of the software operating in the sign module.

Additionally, at block 52, the sign module is initialized as a master sign module for controlling the message display in both the horizontal and vertical directions. Depending on communication packets received from adjacent sign modules (if any), the master or slave status of the sign module may change.

At block 53, the communication packets created in block 52 are transmitted via the horizontal and vertical communication ports of the sign module. At decision block 54, the sign module polls for the presence of a valid keystroke received from an external keyboard.

Figure 5:
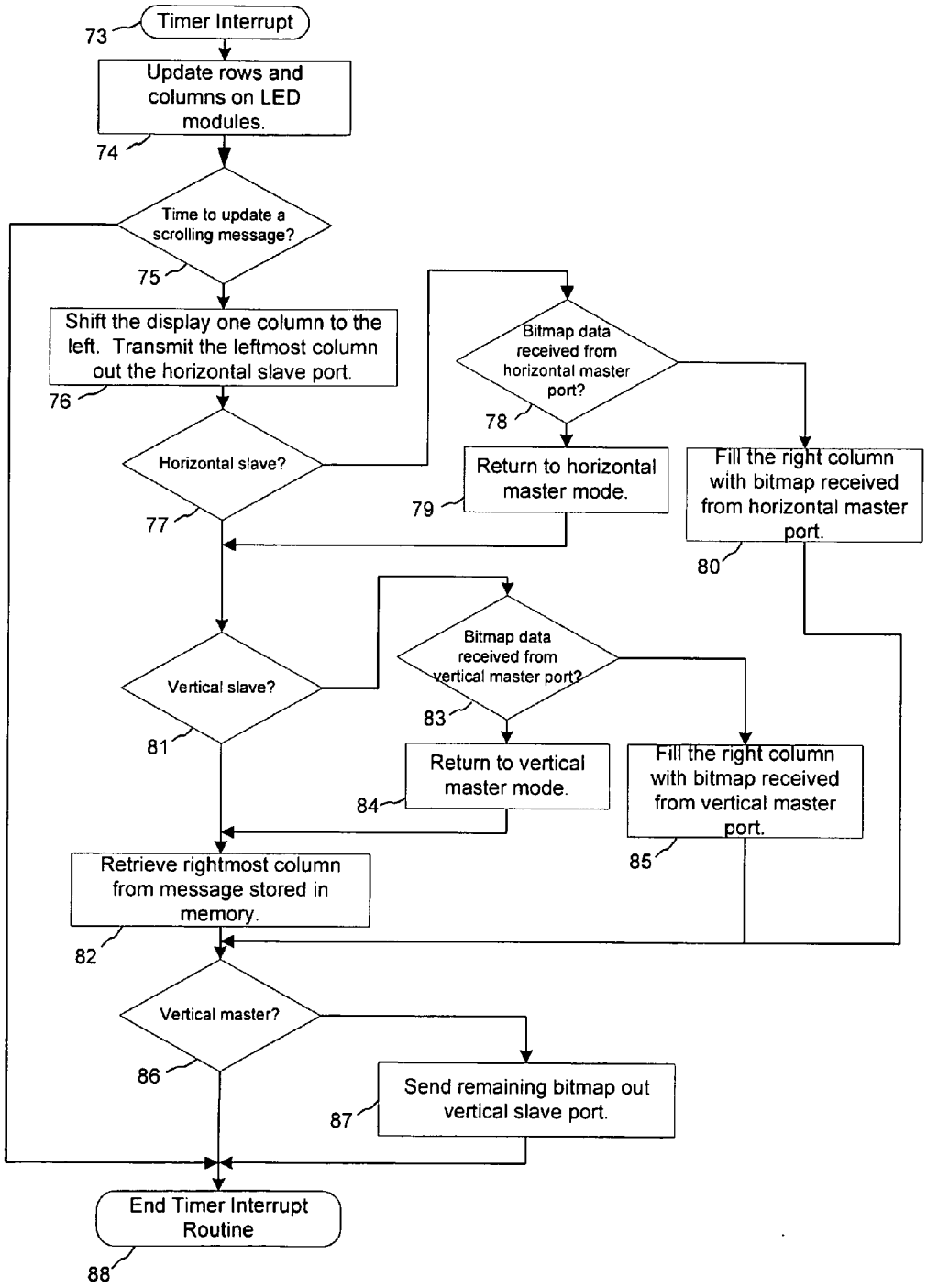
FIG. 5 is a flow diagram of actions that may be undertaken as part of a software interrupt routine according to the invention.

If a valid keystroke is received by the sign module at block 54, and the sign is not operating in a slave mode, the sign module sets a flag at block 55 that prevents further scrolling of the display during timer interrupt routines (described in greater detail in regard to FIG. 5). Keystrokes received from a keyboard may be used to build new text messages or graphics as indicated at block 56 and earlier described. A function key, as earlier described, may toggle the keyboard entry routine between a text mode and graphic mode for interpreting keyboard input. In graphic mode, certain keys, such as number keys, may define which LEDs in a column are to be lit.

At decision block 57, the sign module determines whether an enter or escape key has been received from the keyboard. In this embodiment, an enter or escape key is interpreted in block 57 as meaning that the user has completed entering the new message or graphic. Additional keys can be used to define scrolling, flashing, color, or any other characteristic of the display. When the user has completed the composition of a new message or graphic, the sign module stores the message or graphic in memory, as indicated at block 58, and releases the flags set at block 55 which allows the timer interrupt routine (FIG. 5) to scroll the new message or graphic.

After polling for valid keystrokes, the software may poll for a valid press of the one-shot push button at decision block 59. If the software detects that the user has pressed the one-shot push button, the currently displayed message is replaced at block 60 with a predefined one-shot message stored in the memory. A timer routine at block 51 allows the one-shot message to be displayed for a period of time, preferably long enough for the message to be read by the intended audience. After the one-shot message has been displayed, the previous message display is restored at block 62.

Turning now to FIG. 4B, subsequent to polling the one-shot push button, the software may poll for a valid press of the message select push button at decision block 63. If the software detects that the user has pressed the message select push button, a flag is set at block 64 that prevents further scrolling of the display as a result of the timer interrupt routine (FIG. 5). At decision block 65, the sign module enters a timed loop where the software watches for additional presses of the message select push button. Each press of the message select push button causes the sign module at block 66 to retrieve and display the next message stored in memory. If at decision block 67 the software determines that a time out period has elapsed without additional presses of the message select push button, the software operating in the sign module assumes that the currently displayed message has been chosen by the user. At block 68, the display of the sign module is updated with the newly chosen message which, after removing the flag set at block 64, may begin to scroll across the sign module display.

At decision block 69, the software determines whether a valid communication packet has been received at the sign module's horizontal master communication port. If a valid packet has been received at this port, the software determines that the sign module is currently positioned as a slave module to an adjacent master sign module. At block 70, the software undertakes actions to change from operating in a horizontal master mode to a horizontal slave mode. A flag is set so that other software routines in the sign module know of the horizontal slave status of the sign module.

The communication packet received from an adjacent master sign module may include the master module's software version. At block 70, the horizontal slave module may also compare its own software version for compatibility with the master module's software version. If the slave module determines that the master module has a newer version of software, a message may be displayed to the user of the slave module asking whether an update to the newer version is desired. The message to the user may include instructions as to which button to press to begin or cancel a software update from one module to the other. If the user presses the button to update the software, communication packets are then exchanged between the two signs conveying a copy of the newer version software that will overwrite the older software on the slave sign module. An exchange of software may also occur from a slave sign module to a master module. In this fashion, a number of users can update each other's software at the time the users connect their signs together to create a larger sign matrix.

At block 71, the software operating in the sign module determines if a valid communication packet has been received at the module's vertical master communication port. If a valid packet has been received at the vertical master communication port and the sign module is in a vertical master mode, the sign module undertakes actions at block 72 to change from operating in a vertical master mode to a vertical slave mode. A flag is set in the sign module so that other software routines operating in the sign module know of the vertical slave status. At block 72, the software also directs a communication packet to be communicated upwards through the vertical slave communication port to determine the number of slave signs attached above it. If no response is received from above by the vertical slave communication port, the sign module assumes it is located at the top of a sign matrix and reports a count of "one" module to the sign module below it. If a response is received at the vertical slave communication port from a sign module above, the sign module increments the reported number of sign modules by one and communicates the incremented number to the sign module (if any) below it.

After the push buttons and communication ports have been polled, as indicated in FIGS. 4A and 4B, the software process may return to block 53 to begin a new iteration of the software loop shown.

FIG. 5 is a flow diagram of a software timer interrupt routine that periodically interrupts the main software loop shown in FIGS. 4A and 4B. The interrupts caused by the timer interrupt routine in FIG. 5 may occur at a sufficiently high frequency to provide a visually smooth scrolling display on the sign module. At block 73, the interrupt routine begins and at block 74, the rows and columns of LEDs that provide the message display are updated to provide a visually smooth display. Depending on the scrolling speed of the message, the interrupt routine determines at decision block 75 whether sufficient time has passed to warrant a shift of the bitmap of the display to continue the scrolling message. For example, at block 75 a number of LED updates may be counted to determine if, on this pass through the timer interrupt routine, a shift of message bitmap to the left should occur.

At block 75, the software may also check status flags to determine whether the scrolling of the message has been halted. For example, as noted earlier, status flags may be set to prevent scrolling if the user is editing the message (e.g., as performed at block 56 in FIG. 4A) or choosing a new message (e.g., as shown at block 66 of FIG. 4B), or if the user has configured the current message or graphic to not scroll at all. In cases where the user desires the message to scroll, each column of the bitmap is shifted one column to the left as indicated at block 76. The bitmap at the left edge of a sign module's display is transmitted via the horizontal slave communication port of the sign module for reception and display by a slave module, if any, connected to the left.

When shifting a message display to the left, the sign module must determine the bitmap to display at the rightmost column of the display. At block 77, the sign module examines status flags to determine if the sign module is operating as a horizontal slave module. If the sign module is operating as a horizontal slave, the sign module waits at decision block 78 to receive the bitmap for the rightmost column from the horizontal master sign module to its right. If no communications are received after a brief time out, the sign module assumes it has been disconnected from its horizontal master and resets the software flags at block 79 to resume operation as a horizontal master module. If, at block 78, the sign module receives a communication packet from its horizontal master, the sign module fills its rightmost column at block 80 with the bitmap received in the communication packet.

In this particular embodiment, a sign module operating in a horizontal master mode can define the display in its rightmost column only if there are no signs connected below it. At block 81, the sign module may examine one or more software flags to determine if it is operating in a vertical slave mode. If the sign module is not operating as a vertical slave, the sign module may retrieve the bitmap for the rightmost column from its own stored message or graphic, as indicated at block 82. If the sign module is operating as a vertical slave, the sign module waits at decision block 83 to receive the bitmap for the rightmost column from the sign module below it. If no communications are received from a vertical master module, after a brief time out, the sign module assumes it has been disconnected from its vertical master. At block 84, the sign module may reset the software flags to resume operation as a vertical master. If, at decision block 83, the sign module receives a communication packet from its vertical master below it, the sign module fills its rightmost column at block 85 with the bitmap received in the communication packet.

At this point, the sign module has defined its own rightmost column of the display, but if, at decision block 87, other sign modules are located above it (thus, making the sign module a vertical master for those sign modules above it), the sign module at block 87 communicates the bitmaps for the rightmost column of the vertical slave modules above it through its vertical slave communication port. The timer interrupt routine ends at block 88 after all of the LEDs on the display have been updated or defined.

As may be observed from the foregoing, sign modules of the invention provide a way in which a master sign module in a larger matrix of sign modules may determine and fill the displays of slave sign modules located to the left and above it. For situations where the message is not intended to scroll, and slave sign modules are located to the left and above the master module, the software in the master sign module may scroll the display for a period of time long enough to spread the message or graphic over the entire sign matrix. When the message or graphic has been spread over the entire sign matrix, as determined by displaying the rightmost column of the message or graphic on the rightmost column of the master sign, flags may be set in the master module to halt the scrolling. In other embodiments, the master module may be configured to transmit communication packets to the slave modules to the left and above for purposes of displaying a complete message or graphic on the sign matrix at one instant.

It should be understood that the present invention may be embodied in many other specific forms without departing from the spirit of the invention. Accordingly, the embodiments described above should be considered in all respects as illustrative and not restrictive of the invention. Reference is made to the appended claims rather than to the foregoing description to indicate the scope of the invention. It should be understood that when elements or components are indicated herein to be connected or otherwise attached, the use of such terms does not necessarily indicate or require direct contact between the elements or components that are connected or attached. One or more components or elements may be intermediate to the attached or connected elements or components.

The embodiments of the invention in which an exclusive property or privilege is claimed are defined as follows:

1. A sign module, comprising:

a display configured to display a message;

a processor configured to control the display; and at least one communication port connected to the processor for communicating with a second sign module having a display;

wherein the sign module, when used in association with a second sign module, is configured to determine whether to operate as a master sign module or a slave sign module relative to the second sign module;

and if the sign module determines to operate as a master sign module, the sign module is configured to communicate with the second sign module to control the message on both its display and the display of the second sign module;

and if the sign module determines to operate as a slave sign module, the sign module is configured to communicate with the second sign module and display a message received from the second sign module;

otherwise when not used in association with a second sign module, the sign module is configured to control only the message on its display.

2. The sign module of claim 1, further comprising a plurality of communication ports connected to the processor for communicating with a plurality of other sign modules.

3. The sign module of claim 2, wherein a communication port is disposed on each of a top and bottom side of the sign module, thereby allowing any number of sign modules to be associated with each other in a vertical direction.

4. The sign module of claim 2, wherein a communication port is disposed on each of a left and right side of the sign module, thereby allowing any number of sign modules to be associated with each other in a horizontal direction.

5. The sign module of claim 1, wherein the sign module is associated with a second sign module in a horizontal direction and the processor is configured to scroll the message on the display.

6. The sign module of claim 1, wherein the sign module is associated with a second sign module in a vertical direction, and data is communicated between the sign module and the second sign module to determine the number of sign modules associated in the vertical direction.

7. The sign module of claim 6, wherein the processor is further configured to adjust the size of the message based on the number of sign modules associated in the vertical direction.

8. The sign module of claim 1, wherein the processor is further configured to receive user input to change the content of the message on the display.

9. The sign module of claim 8, wherein the user input is a message select input that causes the processor to display stored messages and receive further input from the user indicating a desired message.

10. The sign module of claim 9, wherein the processor is further configured to replace the message on the display with the desired message indicated by the user.

11. The sign module of claim 8, wherein the user input is a one-shot message input that causes the processor to temporarily display a one-shot message for a predetermined period of time.

12. The sign module of claim 8, wherein the user input enables the user to modify a message for display.

13. The sign module of claim 8, wherein the user input is received from a remote control that communicates with the processor via wireless communication.

14. The sign module of claim 8, wherein the user input is received from a remote control that communicates with the processor via wired communication.

15. The sign module of claim 8, wherein the user input is received from a microphone in communication with voice recognition software operating in the processor.

16. The sign module of claim 1, wherein the processor is further configured to communicate software instructions with a second sign module.

17. The sign module of claim 16, wherein the processor receives software instructions from the second sign module in the form of updated software, and is configured to replace software operating in the sign module with the updated software.

18. The sign module of claim 16, wherein the processor transmits software instructions to the second sign module in the form of updated software.

19. The sign module of claim 1, further comprising a mechanical fastener that physically supports a connection of the sign module to a second sign module.

20. The sign module of claim 1, wherein sign module has a rectangular shape that, when associated with a second sign module having a rectangular shape, results in a rectangular sign matrix.

21. The sign module of claim 1, wherein the sign module is configured to automatically determine whether to operate as a master sign module or a slave sign module at the time it is used in association with the second sign module.

22. The sign module of claim 21, wherein if the sign module determines to operate as a master sign module, the sign module is configured to automatically communicate with the second sign module to control the message on both its display and the display of the second sign module without requiring external user input.

23. The sign module of claim 21, wherein if the sign module determines to operate as a slave sign module, the sign module is configured to automatically communicate with the second sign module and display a message received from the second sign module without requiring external user input.

* * * * *